US009132600B2

(12) United States Patent
Leighton

(10) Patent No.: US 9,132,600 B2
(45) Date of Patent: Sep. 15, 2015

(54) RECLOSABLE BAG

(75) Inventor: Murray Edward Bruce Leighton, Whitley Bay (GB)

(73) Assignee: ILLINOIS TOOL WORKS INC., Glenview, IL (US)

( * ) Notice: Subject to any disclaimer, the term of this patent is extended or adjusted under 35 U.S.C. 154(b) by 2845 days.

(21) Appl. No.: 10/593,752

(22) PCT Filed: Mar. 22, 2005

(86) PCT No.: PCT/GB2005/001090

§ 371 (c)(1),
(2), (4) Date: Jun. 18, 2007

(87) PCT Pub. No.: WO2005/092726

PCT Pub. Date: Oct. 6, 2005

(65) Prior Publication Data

US 2007/0261215 A1 Nov. 15, 2007

(30) Foreign Application Priority Data

Mar. 24, 2004 (GB) ..... 0406620.5

(51) Int. Cl.

| | |
|---|---|
| ***B65D 33/16*** | (2006.01) |
| ***B65D 33/00*** | (2006.01) |
| ***A44B 1/04*** | (2006.01) |
| ***A44B 11/25*** | (2006.01) |
| ***A45B 17/00*** | (2006.01) |
| ***A44B 19/16*** | (2006.01) |
| ***B31B 19/18*** | (2006.01) |
| ***B31B 19/90*** | (2006.01) |

(Continued)

(52) U.S. Cl.

CPC ..... *B31B 19/18* (2013.01); *B31B 19/90* (2013.01); *B65D 33/2541* (2013.01); *B65D 33/2583* (2013.01); *B65D 33/2591* (2013.01); *B65D 75/5866* (2013.01); *B31B 2219/146* (2013.01); *B31B 2219/90* (2013.01); *B31B 2219/9019* (2013.01); *Y10T 24/2534* (2015.01)

(58) Field of Classification Search

CPC ..... B65D 33/2541; B65D 33/2583; B65D 33/2533; B65D 33/2591

USPC ..... 383/63, 65, 66, 36, 906; 24/399, 400, 24/585.12, DIG. 39, DIG. 50

See application file for complete search history.

(56) References Cited

U.S. PATENT DOCUMENTS

| | | | | | |
|---|---|---|---|---|---|
| 2,514,750 | A | * | 7/1950 | Dobbs et al. | 383/64 |
| 2,823,720 | A | * | 2/1958 | Svec et al. | 383/65 |
| 3,220,076 | A | | 11/1965 | Ausnit at al. | |

(Continued)

FOREIGN PATENT DOCUMENTS

| | | | | |
|---|---|---|---|---|
| EP | 0528721 A2 | * | 2/1993 | B65D 33/25 |
| EP | 1 388 503 | | 2/2004 | |
| WO | WO/03080458 | * | 10/2003 | |

*Primary Examiner* — Jes F Pascua
*Assistant Examiner* — Derek Battisti
(74) *Attorney, Agent, or Firm* — McCarter & English, LLP

(57) ABSTRACT

The bag 1 has an opening 20 which is reclosable by way of zipper profiles 24, 26. A spout 30 is formed from flanges of the zipper profiles and folds out from the inside of the bag for use in dispensing its contents. After use, it is folded away and the bag sealed by the zipper. Zippers useful in making the bag are also disclosed (FIGS. 4 to 7), one being a slider zipper. A method of making the bag and apparatus for carrying out the method are disclosed (see FIGS. 8 to 16), as is incorporation of the process in reel-to-reel, pre-made bag and form-fill-seal types of process.

31 Claims, 12 Drawing Sheets

(51) Int. Cl.
*B65D 33/25* (2006.01)
*B65D 75/58* (2006.01)

(56) References Cited

U.S. PATENT DOCUMENTS

| | | | | | |
|---|---|---|---|---|---|
| 3,746,215 | A | * | 7/1973 | Ausnit et al. | 222/92 |
| 3,959,856 | A | * | 6/1976 | Ausnit | 24/399 |
| 4,046,408 | A | * | 9/1977 | Ausnit | 285/188 |
| 4,332,344 | A | * | 6/1982 | Strodthoff | 383/63 |
| 4,363,345 | A | * | 12/1982 | Scheibner | 383/63 |
| 4,691,373 | A | * | 9/1987 | Ausnit | 383/63 |
| 4,812,056 | A | * | 3/1989 | Zieke | 383/65 |
| 5,209,574 | A | * | 5/1993 | Tilman | 383/63 |
| 5,369,847 | A | * | 12/1994 | Naya et al. | 24/30.5 R |
| 5,749,658 | A | * | 5/1998 | Kettner | 383/204 |
| 5,839,831 | A | * | 11/1998 | Mazzocchi | 383/65 |
| 5,902,047 | A | * | 5/1999 | Yeager | 383/203 |
| 5,928,749 | A | * | 7/1999 | Forman | 428/43 |
| 5,931,582 | A | | 8/1999 | Nichols | |
| 6,164,826 | A | | 12/2000 | Petkovsek et al. | |
| 6,251,209 | B1 | * | 6/2001 | Johnson | 156/256 |
| 6,461,044 | B1 | * | 10/2002 | Anderson | 383/211 |
| 6,527,444 | B1 | * | 3/2003 | Buchman | 383/36 |
| 6,609,828 | B2 | * | 8/2003 | Schneider et al. | 383/204 |
| 6,971,794 | B2 | * | 12/2005 | Yeager | 383/61.2 |
| 7,004,630 | B2 | * | 2/2006 | Piechocki et al. | 383/36 |
| 7,204,641 | B2 | * | 4/2007 | Stolmeier | 383/64 |
| 7,213,305 | B2 | * | 5/2007 | Stolmeier et al. | 24/389 |
| 7,540,072 | B2 | * | 6/2009 | Anzini et al. | 24/399 |
| 2003/0230595 | A1 | | 12/2003 | Piechocki et al. | |
| 2003/0231808 | A1 | * | 12/2003 | Machacek et al. | 383/36 |

* cited by examiner

RECLOSABLE BAG

The present invention relates to reclosable bags, zipper for use in making the bags, methods of making the bags and apparatus on which to carry out such methods.

According to the invention there is provided a container having an opening in which are located first and second strips of fastener material which are engageable and disengageable with each other respectively to close and to open the opening, the opening having therein a flexible spout which can be moved into an inoperative position in the interior of the container when not in use and can be moved out into an operative position in which it allows material within the container to be dispensed therefrom, wherein each fastener strip has a respective longitudinal flange and the strips are able to be engaged to close the opening when the spout is in its inoperative position, at least portions of the respective longitudinal flanges of the fastener strips being secured to each other to form the spout.

If the flanges of the fastener strips are plastics material, they can conveniently be secured together by heat sealing.

Conveniently, the fastener strips have further respective longitudinal securing flanges which secure the fastener strips to the container adjacent to the opening.

Advantageously, the fastener strips have respective longitudinal grasping flanges which protrude outwardly of the opening and can be grasped manually to disengage the fastener strips and open the opening.

Alternatively, the fastener strips may have a slider mounted thereon, the slider being movable along the strips to engage and disengage them.

Preferably, each end of each fastener strip is secured to the adjacent end of the other strip.

The container may be formed from flexible sheet material, for example plastics.

Advantageously, the container comprises first and second panels of sheet material forming respectively front and rear major faces of the container.

The first and second panels may be formed by folding a single sheet of material.

If desired the container may have respective gussets between opposed edges of the front and rear faces. In such a container, the opening is preferably in one of the gussets.

Preferably, the opening is in one of the major faces of the container.

In a preferred container the faces are quadrilateral and the opening extends parallel to a first pair of opposite edges of the quadrilateral, conveniently substantially mid-way between the pair of edges. If the quadrilateral is a rectangle, the major sides of the rectangle may constitute the pair of edges.

Conveniently, the mid-point of the opening is located approximately two-thirds of the distance between the minor sides of the rectangle.

In other containers according to the invention, the opening may be located in a seam of the container, preferably a back seam extending across one major face of the container or, in other cases, a side seam, conveniently one which defines one side of one of a pair of side gussets of a gusseted container. Further, it is possible to provide the opening in an extension part of the container formed particularly for that purpose.

In all cases, the opening leaving the spout preferably extends over only a portion of the length of a seam of the container. Moreover, the opening having the spout is preferably not the top opening of the container.

If desired, the container may have a further opening through which material can be introduced into the container. The container may then be what is known as a "pre-made bag".

The further opening may be capable of being closed by heat-sealing of the sheet material adjacent the further opening.

Conveniently, the container is closed along a first one of the second pair of opposite edges and is open along the second one of the second pair.

Advantageously, the container is closed along the said first pair of edges by heat sealing and can be closed by heat sealing along the said second pair of edges.

For use in the manufacture of bags and containers mentioned above, the invention also provides a zipper or reclosable fastener comprising first and second strips of fastener material which are engageable with and disengageable from each other, each strip comprising an elongate body portion which is shaped for releasable engagement with the body portion of the other strip and first and second longitudinal flanges, the first flanges extending away from a plane of separation of the strips and the second flanges extending in the same direction substantially parallel to the plane of separation. The first flanges are used to secure the zipper in the finished container; the second flanges form the spout.

Preferably, the first flanges are narrower than the second flanges, more preferably at least one-half the width of the second flanges.

In preferred zippers, each first flange is from 2 mm to 10 mm in width and, independently, each second flange is from 20 mm to 100 mm in width, more preferably from 20 mm to 70 mm in width.

If desired, the zipper may be fitted with at least one slider movable along the fastener to engage and disengage the fastener strips.

Advantageously, each fastener strip has a third longitudinal flange which extends in a plane substantially parallel to the plane of separation in a direction opposite to that in which the respective second flange extends. The third flanges can be used to open the zipper in the finished container.

Advantageously, the fastener strip is provided with a peel-seal, between the third flanges or otherwise, which must be separated prior to opening of the container, thus providing a tamper evident feature.

Preferably, each third flange is from 10 mm to 50 mm in width, more preferably from 10 mm to 30 mm in width.

Advantageously, the second and third flanges of each strip are substantially coplanar with each other and, independently thereof, the first flanges may extend in planes substantially perpendicular to the plane of separation.

The invention also provides a reclosable fastener comprising first and second strips of fastener material which are engageable with and disengageable from each other, each strip comprising an elongate body portion which is shaped for releasable engagement with the body portion of the other strip, each strip having at least first, second and third longitudinal flanges. The first, second and third flanges have functions as mentioned above.

The preferred widths of the first and second flanges are as already stated.

Preferably, each third flange is from 10 mm to 50 mm in width, more preferably from 10 mm to 30 mm in width.

In line with their purpose already mentioned, the second flanges of the strips may be joined to each other and cut to form a spout portion.

A pre-cut length of zipper for forming the spout accordingly comprises a length of reclosable fastener as mentioned above having a single spout portion.

The zipper may however be a continuous uncut length from which pre-determined lengths of zipper may be severed.

The spout may be formed by the second flanges being joined, for example by heat sealing, along a line which extends from a first point adjacent one end of the body portions to a second point on the lateral edges of the second flanges lying closer to the opposite end of the body positions than the first end and are cut along respective lines extending from the second point back to the body portions.

Conveniently, the lines along which the second flanges are cut extends substantially perpendicularly to the body portions.

To provide a convenient spout shape, the lines along which the second flanges are joined is curved in the direction away from the body portions.

Preferably, the portions of the second flanges lying to the side of the line along which they are joined distant from the body portions are removed.

Similarly, the portions of the second flanges lying to the side of the lines along which the flanges are cut opposite to the spout portion may be removed, or may simply be left unused.

To use in the formation of the container the invention provides a web of sheet material having a plurality of spaced openings therein, each opening having a length of fastener according to the invention located and secured to the sheet material by its first flanges to respective sides of the opening.

Preferably, the openings are spaced along and aligned with a line extending longitudinally of the web.

Advantageously, the web is in the form of a continuous rectangular strip and the line extends parallel to first and second opposite side edges of the strip.

Conveniently, the line is substantially mid-way between the side edges.

The web may be rolled longitudinally for subsequent use, the method then being a procedure of kind known as a "reel-to-reel" process.

The invention further provides a method of making a container formed from flexible sheet material, the method comprising:

providing a piece of flexible sheet material having an elongate opening therein;

presenting to the opening a length of reclosable fastener according to the invention;

securing the first flanges of the fastener strips to the sheet material at respective opposite sides of the opening; and joining and cutting the second flanges of the fastener strips to form a flexible spout located in the elongate opening in which the fastener length is located and its strips are engageable and disengageable with each other respectively to open and close the opening.

Preferably, the joining and cutting operations are carried out prior to the presentation of the fastener to the opening.

The joining and cutting operations may be as described above to form the spout.

Preferably, the piece of flexible sheet material has a plurality of elongate openings therein and the operations of the above method are carried out on each opening.

Conveniently, the piece of material is a continuous web and the openings are spaced along and aligned with a line extending longitudinally of the web.

Conveniently and as already mentioned, the web is in the form of a continuous rectangular strip and the line extends parallel to first and second opposite side edges of the strip, preferably substantially mid-way between the side edges.

If desired, the method includes the further step of forming the web into a continuous string of bags, each of which has a reclosable opening formed with a spout, and separating the string into individual bags.

Preferably, each bag has a further opening through which the bag can be filled.

Alternatively, if desired, the method includes the further step of feeding the web to a form-fill-seal machine, at which individual sealed bags containing material introduced by the machine are formed, each bag having a reclosable opening formed with a spout.

Conveniently, the joining and cutting operations are carried out whilst the fastener length is received in a groove of a rotary turret which is used to present the fastener length to the flexible material.

If desired, the zipper has third flanges as mentioned above and the third flanges are passed through the opening to form flaps for opening of the reclosable fastener.

The invention provides in another aspect an apparatus for carrying out a method according to the invention, comprising a means for receiving a length of zipper, means for advancing a piece of flexible sheet material through a station at which the zipper-receiving means is located, means for feeding lengths of zipper according to the invention to the zipper-receiving means, cutting and joining means for carrying out the cutting and joining operations on the zipper, and means for securing at least one of the first flanges of the zipper length to the sheet material adjacent the opening therein.

Preferably, the cutting and joining means are located for carrying out at least one of the cutting operation and the joining operation on the zipper length when received in the zipper-receiving means.

Advantageously, the cutting and joining means are located to carry out both the said operations on the zipper length when received in the zipper-receiving means.

The apparatus preferably includes means for cutting a continuous length of zipper into pre-cut lengths prior to its presentation to the zipper-receiving means.

Conveniently, the zipper-receiving means comprises a rotary turret having a plurality of parallel zipper-receiving grooves and rotatable about an axis parallel to the grooves.

Preferably, the apparatus includes a further means for securing the other first flange of the zipper length to the sheet material at the opposite side of the opening.

Conveniently, the further securing means is located at a separate, downstream operating station of the apparatus.

Preferably, the apparatus includes a means for forming the opening in the film.

Conveniently, the apparatus means for forming the opening is located at a further, upstream station.

If desired the apparatus includes a means for rolling the film to which the fasteners have been applied.

Also if desired, the apparatus includes a means for forming fillable bags from the film material, or a form-fill-seal means for forming the film material into bags and filling the bags.

Embodiments of the invention and examples of processes according to the invention will now be described by way of example with reference to the drawings of this specification, in which.

Figure 4:
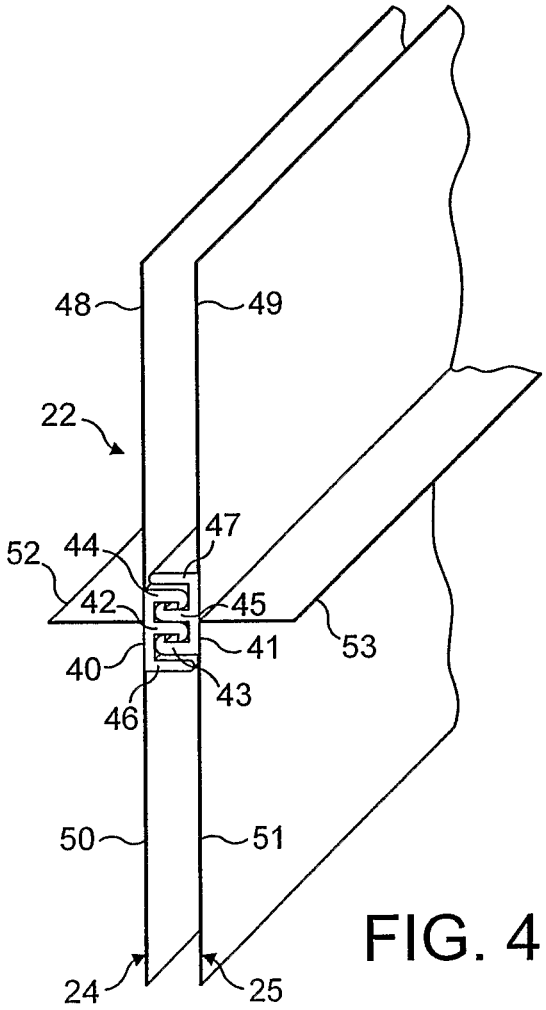
FIG. 4 is a perspective view of a portion of a zipper used in the manufacture of the bag of FIGS. 1 to 3.
Figure 5:
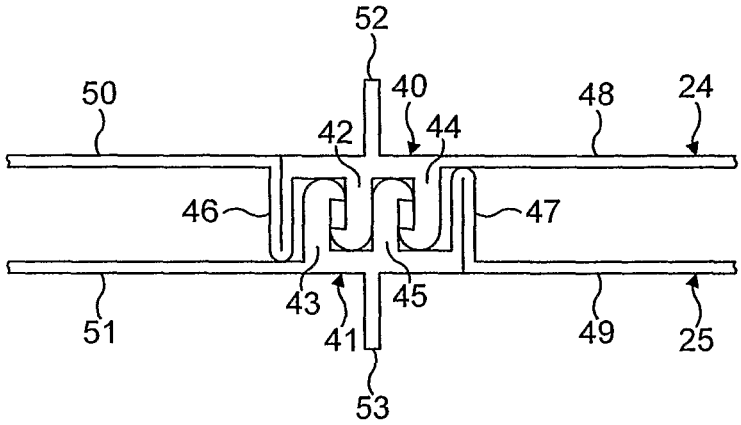
FIG. 5 is a sectional view of a portion of the zipper of FIG. 4 on an enlarged scale.
Figure 6:
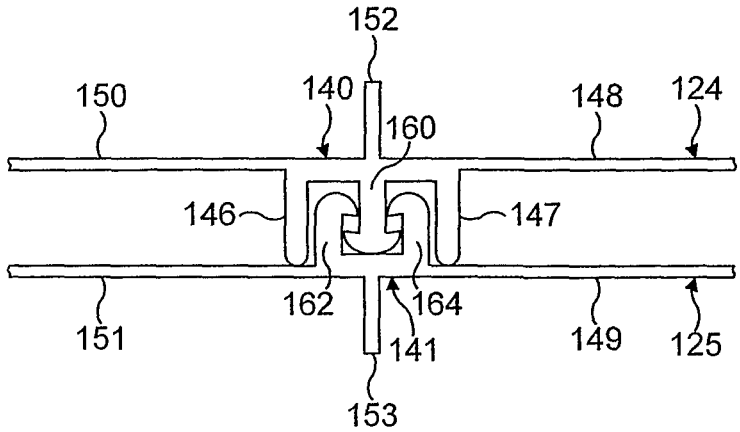
Figure 7:
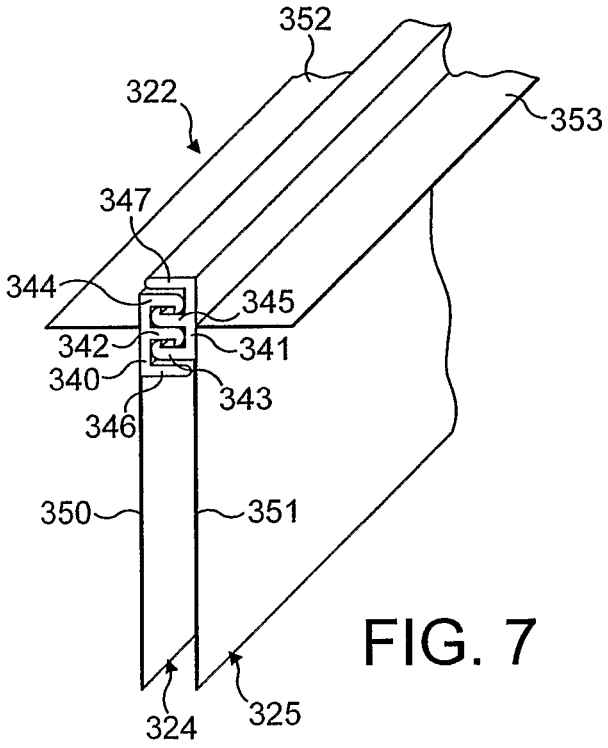
Figure 8:
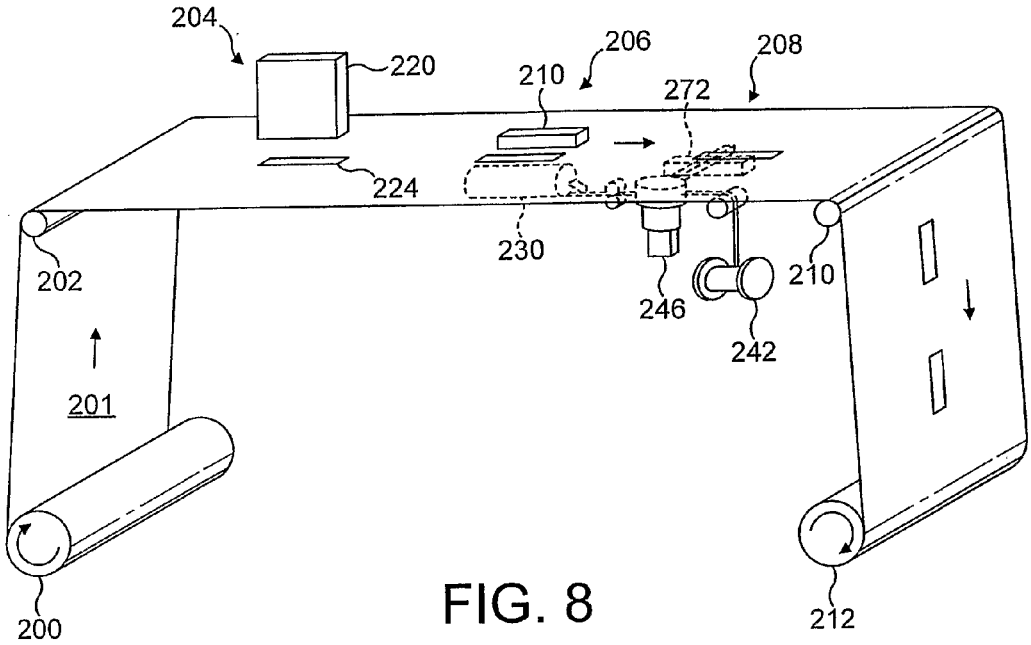
Figure 9:
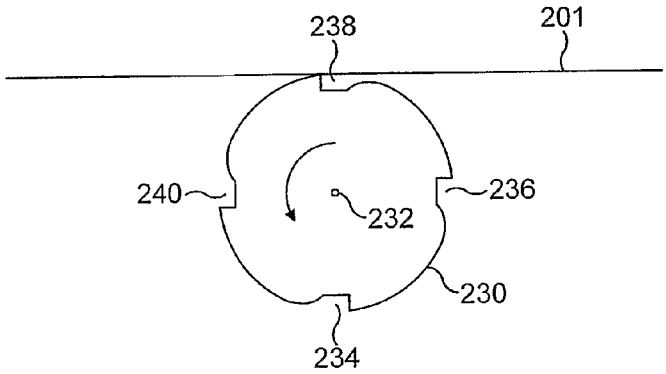
Figure 10:
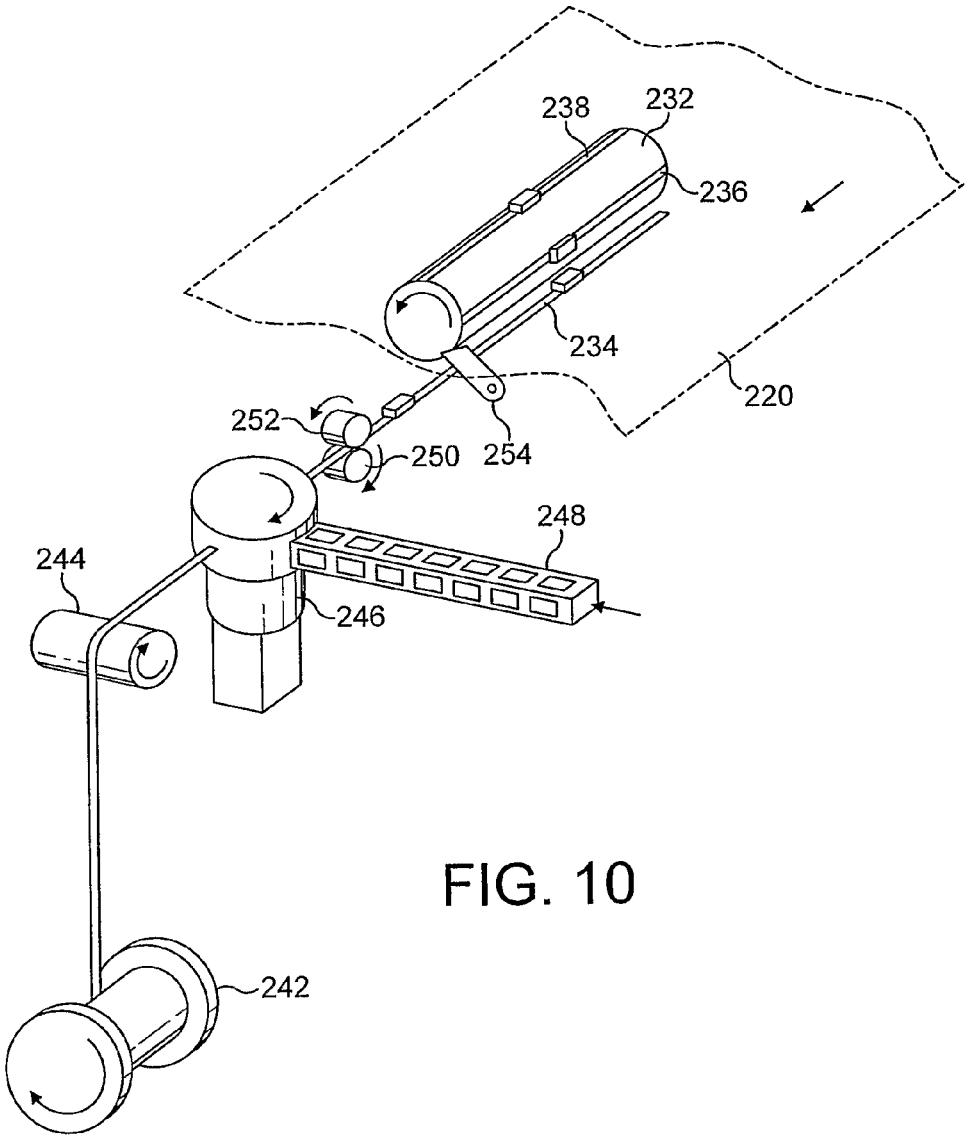
Figure 11:
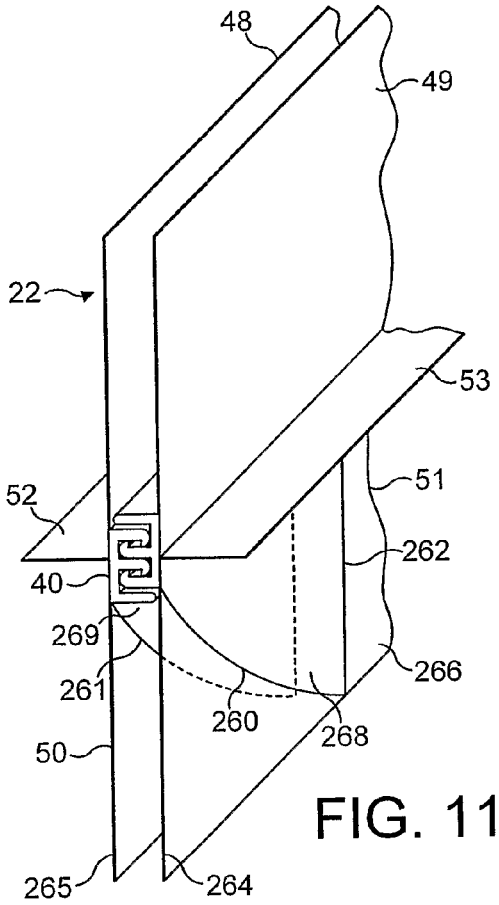
Figure 12:
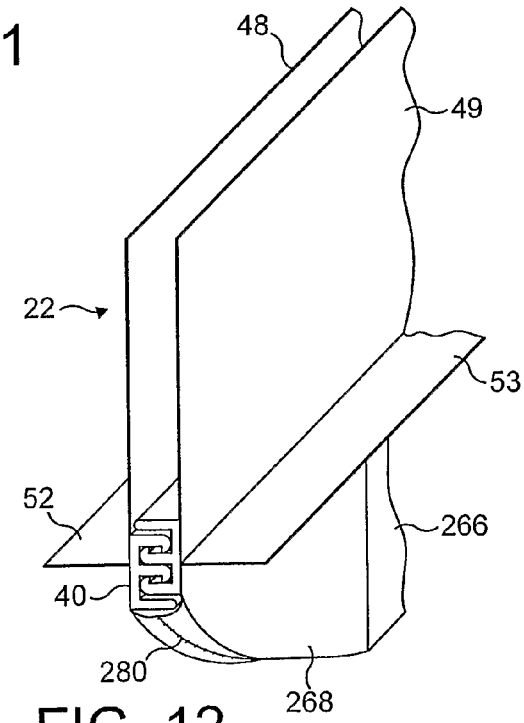
Figure 13:
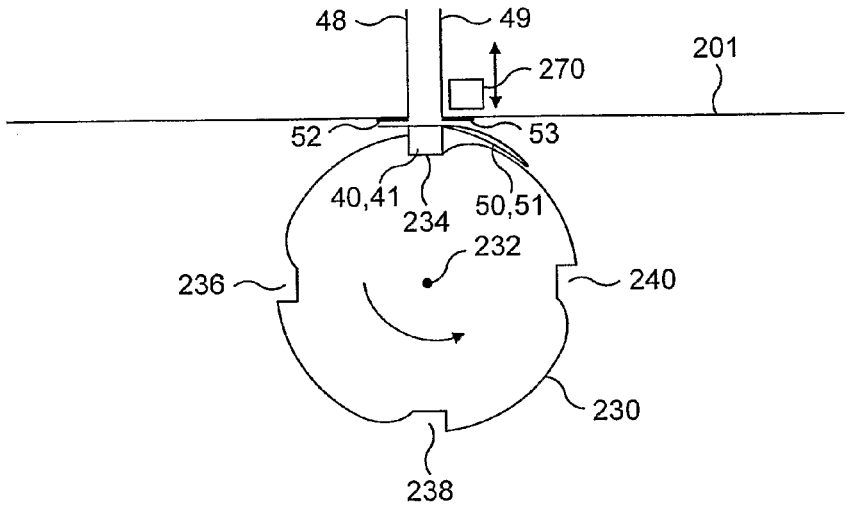
Figure 14:
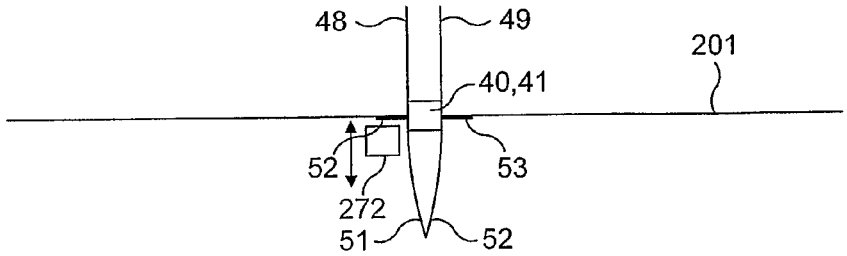
Figure 15:
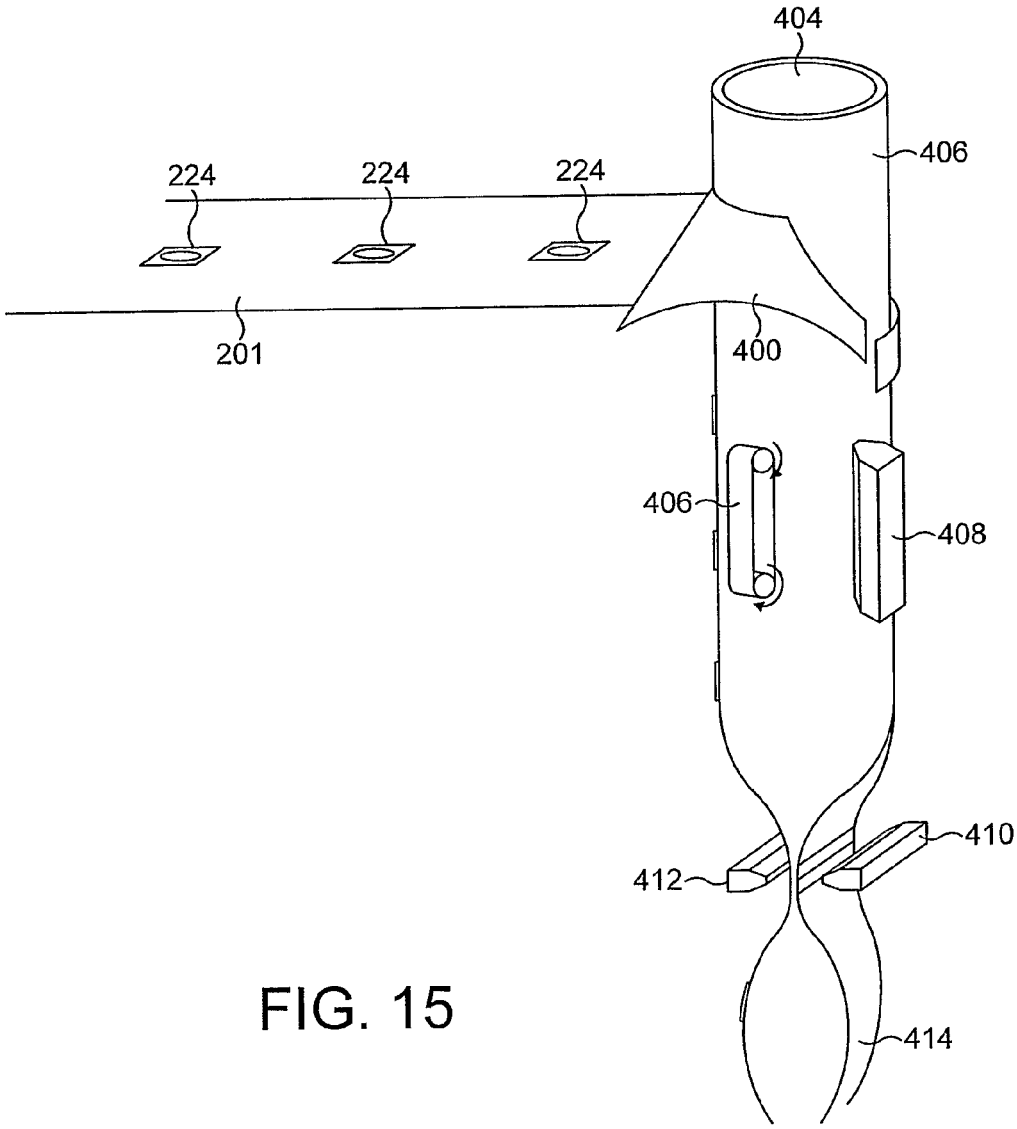

FIG. 6 corresponds to FIG. 5 but shows a modified zipper;

FIG. 7 corresponds to FIG. 4 but shows another modified zipper;

FIG. 8 is somewhat schematic perspective view of an apparatus for carrying out a process for applying the zipper of FIGS. 4 and 5 or of FIG. 6 to a web of plastics film material;

FIG. 9 shows a portion of the apparatus of FIG. 8;

FIG. 10 shows a further portion of the apparatus of FIG. 8;

FIG. 11 shows the zipper of FIGS. 4 and 5 at an intermediate stage in the process carried out on the apparatus of FIG. 8;

FIG. 12 corresponds to FIG. 11 but shows the zipper at a later stage in the process;

FIGS. 13 and 14 shows the zipper at still further stages in the process;

FIG. 15 shows a modification of the apparatus of FIG. 8; and

Figure 16:
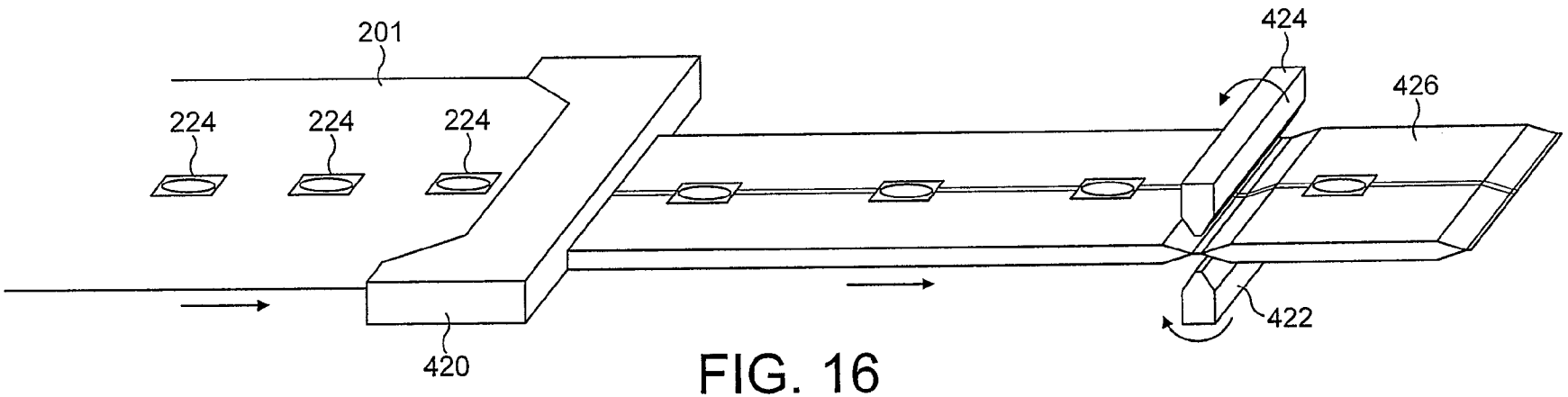

FIG. 16 shows a further modification of the apparatus of FIG. 8.

Figure 1:
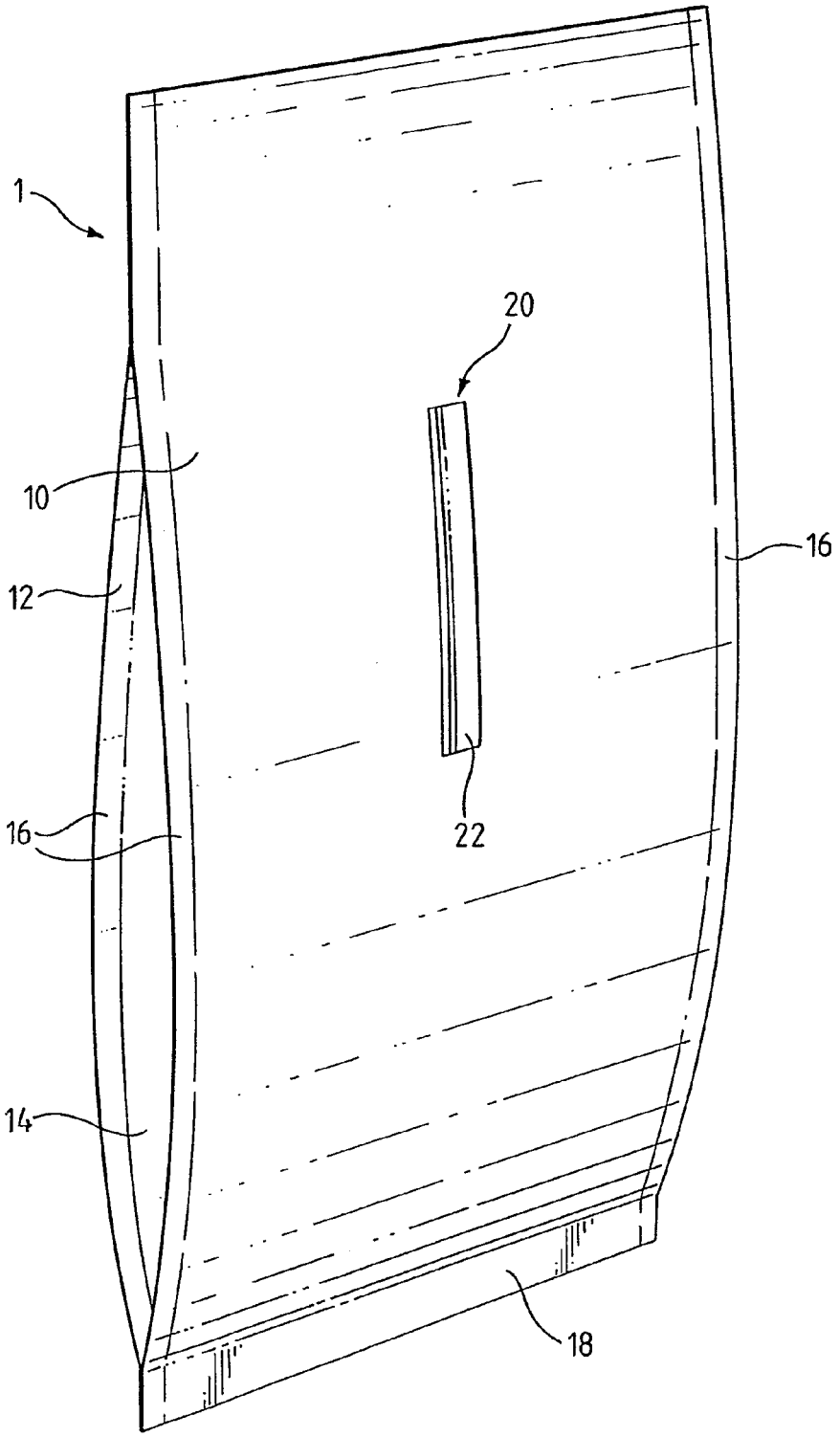
FIG. 1 is a perspective view of a bag in a closed condition.
Figure 2:
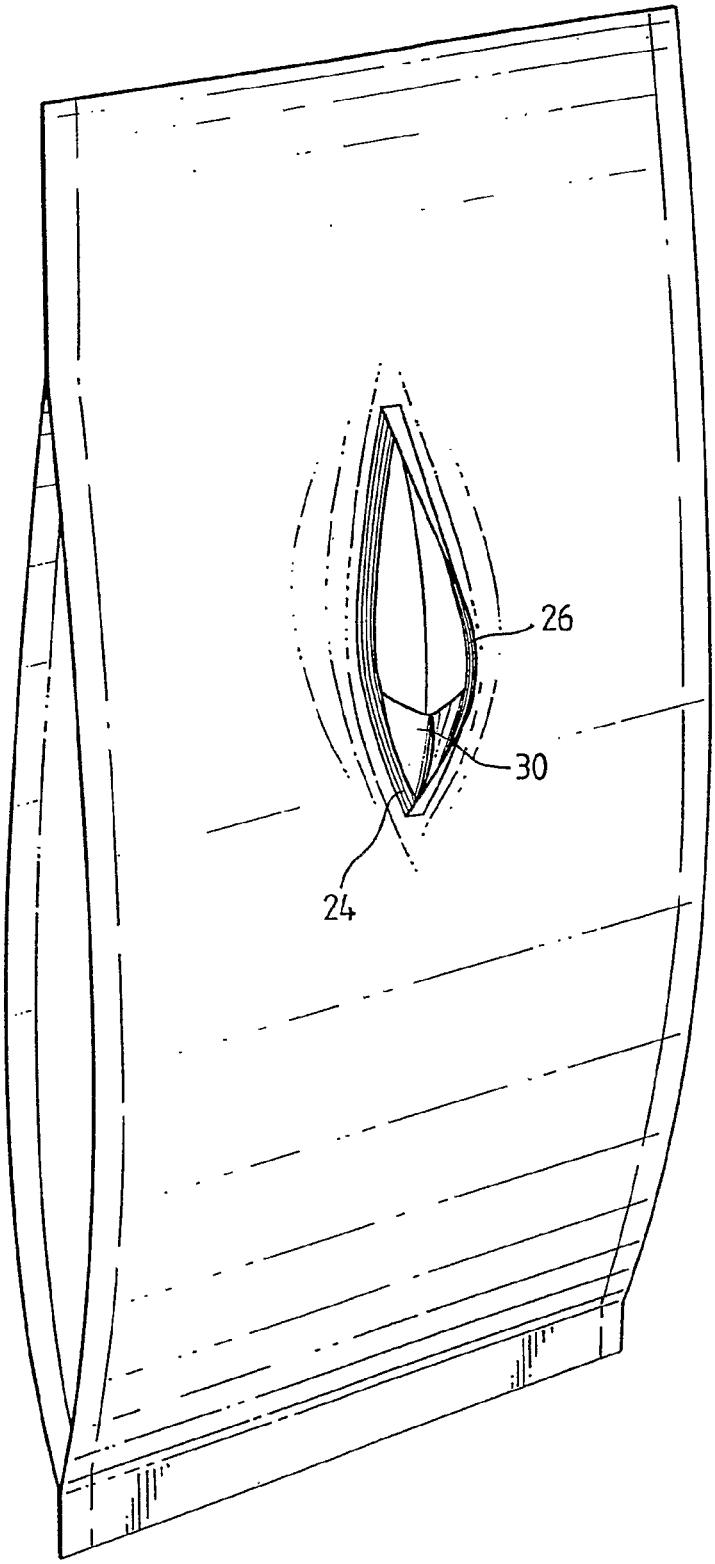
FIG. 2 is a perspective view of the bag of FIG. 1 in an open condition.
Figure 3:
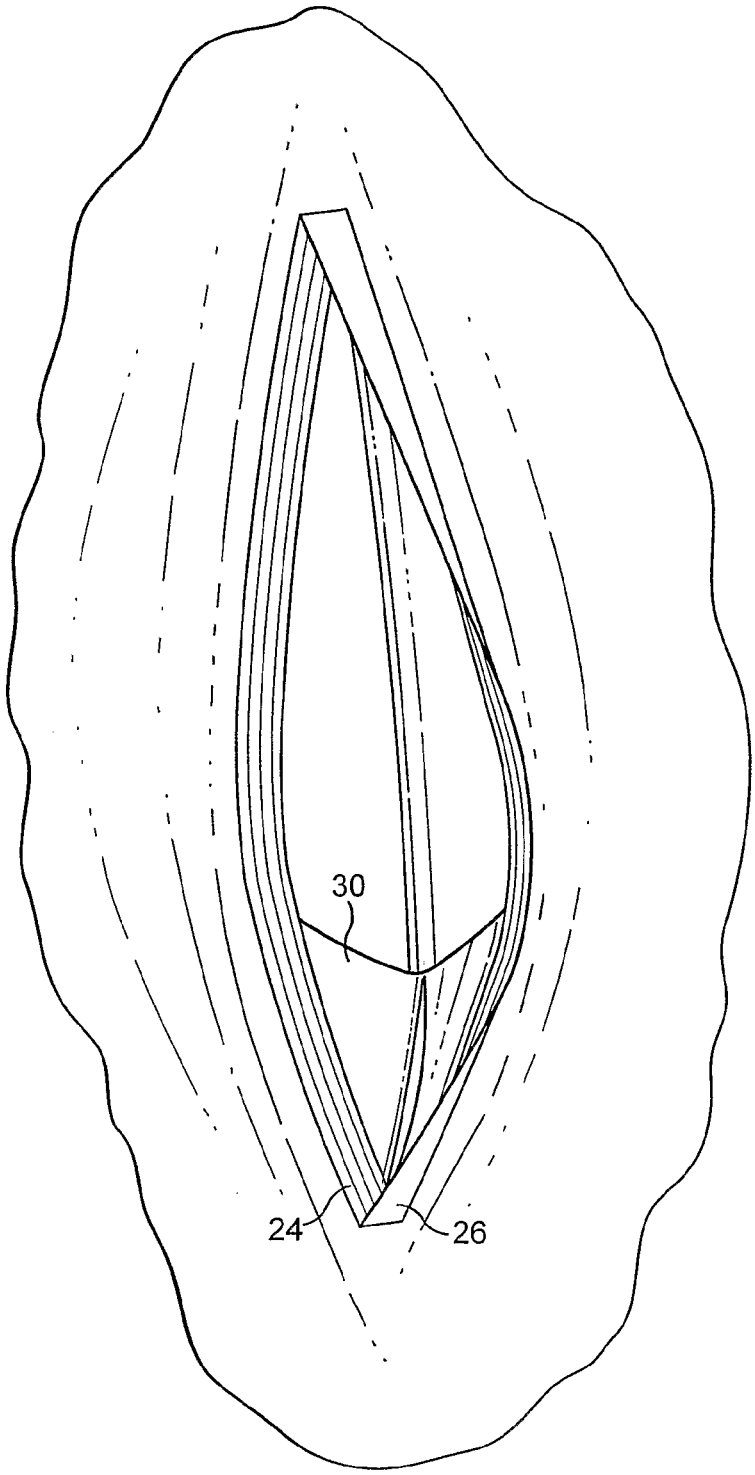
FIG. 3 is an enlarged view of a portion of the bag as shown in FIG. 2.

FIGS. 1 to 3 show a bag which is made from a suitable plastics film material such as polyethylene.

The bag has a rectangular front panel 10, a rectangular rear panel 12 and two gusseted side panels 14. The front and rear panels 10, 12 are joined to the side panels 14 by respective welds 16 formed by the application of heat and pressure to the plastics film material. The bag may be constructed from individual panels 10, 12, 14 joined by the welds 16 which are then seams, or, as is preferred, folded from a single piece of film material. In the latter case, the bag may have a longitudinal back seam where the longitudinal edges of the film overlap and are heat sealed to each other. When present, the back seam is preferably located centrally of the rear panel 12. In an alternative construction, also formed from a single piece of material, the longitudinal edges of the film may be joined to each other at one of the welds 16. When the bag is constructed from more than one piece of film, the pieces of the film are preferably joined to one another at the side seams 16. In all the constructions mentioned, the side seams 16 which do not form a joint between separate pieces of film material are formed by welding the folded film to itself each side of the respective fold line.

A transverse bottom weld 18 is formed by the application of heat and pressure to the film material. The bottom weld 18 joins the front, rear and side panels 10, 12, 14 together to close the bottom of the bag. In the condition shown in FIGS. 1 to 3, the top of the bag is open.

The bag 1 has an opening 20 which is formed in the lateral centre of the front panel 10 and has its mid-point located approximately two-thirds of the way towards the top of the bag in the longitudinal direction. The opening 20 takes the form of a rectangular slot which is about 95 mm long and about 8 mm wide in this embodiment.

The opening 20 is closed by a length 22 of reclosable fastener of the kind known as a zipper. This is described in more detail below but suffice it to say here that the zipper length 22 consists of first and second profiles 24, 26 which are shaped to fit together to engage to form a closure which can be opened by pulling the profiles 24, 26 apart, after which they can be re-engaged. The opening 20 can thus be repeatedly opened and reclosed to gain access to the interior of the bag and to seal it closed.

Many different types of zipper are known in the art. These types include zippers in which the profiles are dissimilar, for example one is a male profile and the other a female, and profiles which are identical to each other and engage by reception of one or more protruding ribs on one profile in a respective groove or grooves in the other profile. These latter types of zipper include types known as "double track" and types known as "single track" depending on the number of ribs and grooves the profiles have.

In the opening 20 the bag 1 has a flexible spout 30 which folds away inside the bag when the opening 20 is closed and which opens out, as shown in FIGS. 2 and 3, when the opening is opened. The spout 30, when opened out, facilitates pouring of the bag contents, this being particularly advantageous when the contents are flowable, for example, liquid, particulate or granular. The spout 30 is formed from the zipper 22 in a way which is described below.

First however the zipper itself will be described in more detail with reference to FIG. 4. It will be seen here that the zipper 22 consists of its two profiles 24, 25. Each profile 24, 25 consists of a body portion and three flanges, the respective body portions and flanges of each zipper being formed integrally and in continuous lengths by extrusion of a suitable plastics material, for example LDPE. The profiles 24, 25 are separated and joined by movement to the left and right as the zipper is seen in FIG. 4. A plane of separation therefore lies between the profiles mid-way between the flanges 48, 50 and the flanges 49, 51 and extending vertically as shown in FIG. 4.

The profile 24 will be described first. Its body portion 40 is formed with two parallel ribs 42, 44 of hooked profile and a further rib 46 which extends parallel to the hooked ribs 42,44 and has a section which is rectangular apart from a rounded free end. The ribs 42, 44, 46 are shown in more detail in FIG. 5.

In addition to the body portion 40, the profile 24 has three longitudinally extending flanges. These consist of an outer flange 48, an inner flange 50, which extend in generally opposite directions from the body portion 40 in a plane generally perpendicular to the separation direction of the profiles 24, 25 and a lateral flange 52 which extends in a plane extending generally in the separation direction of the profiles 24, 25 and therefore generally perpendicular to the planes of the inner and outer flanges 48, 50. The lateral flange 52 is significantly narrower than the inner and outer flanges 48, 50, as can be seen in FIG. 4. The significance of the terms "inner" and "outer" will become clear later in this description.

The profile 25 will now be described. It has a body portion 41 which, like the body portion 40 of the profile 24, has two parallel ribs 43, 45 of hooked profile and a further rib 47 which extends parallel to the hooked ribs 43, 45. The further rib 46 has a section which is rectangular apart from a rounded free end. The ribs 43, 45, 47 are shown in more detail in FIG. 5.

Also like the profile 24, the profile 25 has, in addition to the body portion 41, an outer flange 49, an inner flange 51 and a lateral flange 53. The flanges 49, 51, 53 extend in planes such that the flanges form a mirror image of the flanges 48, 50, 52 of the profile 24.

In the particular zipper of FIG. 4, the flanges 48, 49 are about 20 mm wide, the flanges 50, 51 are about 50 mm wide and the flanges 52, 53 are about 5 mm wide.

As will be seen from FIG. 5, the body portions 40, 41 of the profiles 20, 25 fit together such that the rectangular-section ribs 46, 47 lie to the outside of an interlocking closure formed between the hooked ribs 42, 43, of the profile 22 and the hooked ribs 44, 45 of the profile 25, engage with each other such that the hooked portions of the hooked ribs contacting each other so as to resist separation of the profiles 24, 25.

When the profiles 24, 25 are engaged with each other the zipper 22 has a configuration as shown in FIG. 4 in which the outer flanges 48, 49 extend away from the body portions in substantially parallel planes in one direction and the inner flanges, 50, 51 extend in the opposite directions and again parallel to each other, the lateral flanges 52, 53 extending in opposite directions in a plane perpendicular to those of the outer and inner flanges 48, 49, 50, 51.

FIG. 6 of the drawings shows an alternative form of zipper. Parts of the zipper of FIG. 6 corresponding to those of the zipper of FIGS. 4 and 5 are represented by reference numerals increased by "100" compared with the reference numerals used in FIGS. 4 and 5. The engagement between the body portions 140, 141 of the zipper 122 shown in FIG. 6 is however between a male rib 160 on the profile 124 and a female groove formed between parallel ribs 162, 164 on the zipper profile 125. The male rib 160 has a "mushroom" cross-section which is received between hooked portions at the distal ends of the female ribs 162, 164, to secure the profiles 124, 125 together.

FIG. 7 of the drawings shows a further modified zipper which corresponds to the zipper of FIG. 4 but has the outer flanges 48, 49 omitted. Parts of the zipper of FIG. 7 corresponding to FIG. 4 are indicated by reference numerals increased by "300". The zipper of FIG. 7 is intended to be engaged and disengaged by means of a slider (not shown) which is mounted on the profiles 324, 325 and is shaped in known manner to cause engagement and disengagement of the profiles as it is slid along.

In any embodiment of the invention, the zipper may include one or more tamper-evident features, for example a peelable barrier layer or a film element which must be severed in order to open the container.

The application of the zipper of FIGS. 4 and 5, the zipper of FIG. 6 or the zipper of FIG. 7 to plastics film material from which the bag of FIGS. 1 to 3 can be made will now be described with reference to FIGS. 8 to 14 of the drawings.

FIG. 8 is a general schematic perspective view of an apparatus for the manufacture of a continuous web of plastics film from which the bag of FIGS. 1 to 3 can be made in a subsequent operation.

FIG. 8 shows a supply roll 200 of plastics film material, from which a web 201 is fed vertically upwards by drive means (now shown), around a first diverting roller 202, then horizontally past first, second and third stations 204, 206, 208 where operations described below are carried out, around a second diverting roller 210 and then vertically downwards to a take-up roll 212 of film which can then be used in subsequent processes, two of which are described below.

The operations carried out at the first, second and third stations 204, 206, 208 will now be described.

At the first station 204, the web 201 is stopped and a punch 220 is used to cut a rectangular opening 224 in the film, the opening corresponding to the slot 20 in the bag described with reference to FIGS. 1 to 3 of the drawings. After cutting of the opening 224, the web 201 is restarted and advanced so that the opening 224 comes to the second station 206 where the web is again stopped. At the second station 206, the first stage of the application of the zipper shown in FIGS. 4 and 5. The second stage of attachment of the zipper is carried out at the third station 208 and is described below.

The operation carried out at the second station 206 will now be described in more detail with reference to FIGS. 9 to 13 of the drawings. FIG. 9 shows the web 201 of plastics film material passing over a rotary turret which takes the form of a cylindrical drum 230 having four equally-spaced axial grooves 234, 236, 238, 240 in its cylindrical surface. The grooves 234, 236, 238, 240 are shaped as shown in FIG. 9 and each comprises a rectangular-section shape which is relieved by a portion of tapering section at its trailing edge. The drum 230 is driven by drive means (not shown) to be rotatable in a counter-clockwise direction about a horizontal axis 232 which is parallel to the plane in which the web 201 moves between the guide rollers 202, 210 and aligned with the direction of movement of the web. The purpose of the turret is to locate lengths of zipper in the slots 224 cut in the web 201 at the first station 204.

FIG. 10 of the drawings shows apparatus whereby a continuous supply of the zipper 22 shown in FIGS. 4 and 5 is fed from a supply spool 242, around a directional roller 244 to a rotary slider applicator 246, at which sliders from a supply cartridge 248 of sliders are attached to the zipper. The slider applicator 246 can be of a conventional kind which is available from Supreme Plastics Limited of Supreme House, 300 Regents Park Road, London N3 2TL, UK. From the zipper applicator 246, the zipper is fed by counter-rotating drive rollers 250, 252 to the rotating turret 230 where it is fed into a first groove 234 at the "six o'clock" position. A knife 254 severs a pre-determined length of zipper corresponding to the length of the grooves 234, 236, 238, 240 in the turret 230. After the length of zipper has been fed into the first groove, the turret is rotated counter-clockwise through 90°, so that the length of zipper is moved to the "3 o'clock" position. At this position, operations are carried out on the inner flanges 50, 51 of the zipper 22. The operations consist of a cutting and sealing operation using a shaped cutting knife and sealing bar (not shown) which are arranged to cut the inner flanges 50, 51 along the curved lines 260, 261 shown in FIG. 11 of the drawings and along the straight lines 262, 263 also shown in FIG. 12. As a result, the portions of the flanges 264, 265 shown in FIG. 10 are removed and fall away to waste. The flange portions 266, 267 shown in FIG. 11 remain attached to the respective body portions 40, 41 of the zipper but are otherwise left loose. Alternatively, they could be cut away and allowed to go to waste. The portions 268, 269 of the flanges 50, 51 lying between the curved lines 260, 261 and the straight lines 262, 263 form the spout 30 of the bag shown in FIGS. 1 to 3 of the drawings, the curved edges of these portions being joined along a line 280. After these operations have been carried out at the "3 o'clock" position, the rotary turret is turned through a further 90° in the counter-clockwise direction so that the zipper which has been treated as described is brought to the "12 o'clock" position where it lies immediately beneath the film 201. At this point, the advancing film is brought to a stop with the slot 224 in alignment with the slot 234 in the cylindrical surface of the rotating turret 230. At this position, the upper flanges 48, 49 of the zipper 22 are inserted through the slot 224 in the web 220 so that the lateral flanges 52, 53 lie against the lower surface of the web 220 to each side of the slot 224. The inner flanges 50, 51 now shaped and secured together to form the spout 30 lie against the cylindrical outer surface of the rotating turret, as generally shown in FIG. 12 of the drawings.

At this position, a sealing bar 270 located above the web and aligned longitudinally with the slot 224 is applied to the web and seals the trailing lateral flange 53 of the zipper 22 to the lower face of the web 220 adjacent the slot 224. This completes the operations which are carried out at the second station.

The zipper shown in FIG. 6 can be used instead of the zipper shown in FIGS. 4 and 5 in a completely analogous procedure. If the zipper shown in FIG. 7 is substituted for the zipper shown in FIGS. 4 and 5, the procedure is similar to that described except that there are no outer flanges to pass through the opening 224 in the film 201.

It will be noted that the shapes of the grooves 234, 236, 238, 240 in the turret 230 allow for the inner flanges of whichever zipper is used to lie against the surface of the turret as the zipper is progressed from the "6 o'clock" to the "12 o'clock" position.

It will also be noted that it is not essential to carry out the cutting and sealing operations to form the spout whilst the zipper is located in the turret grooves. These operations, or either of them, may be carried out at other locations. Either or both operations may also be carried out before the zipper is cut into individual lengths. Further, the turret may be replaced by any other means for application of the zipper, for example a reciprocating bar having a zipper-receiving groove. The spout-forming operations may be carried out on the zipper when in the groove, or otherwise.

Returning now to FIG. 8, the web is advanced so that the portion of the web containing the slot 224 with the length of zipper attached thereto is presented to the third station 208. Whilst the film is advanced in this way, the rotating turret is turned counter-clockwise through a further 90° so that the next following slot 240 is presented at the "6 o'clock" position to receive a further cut length on zipper, the zipper previously loaded at the "6 o'clock" position is moved to the "3 o'clock" position to be trimmed and sealed to form the spout as described above. The previous zipper length which has been trimmed and sealed is advanced to the "12 o'clock" station to be attached to the web as described above. At the third station 208, a further seal bar 272 beneath the film 201 is applied to the zipper strip so that the opposite lateral flange 52 becomes sealed to the web 220 at the side of the slot 224. From this position, the film is advanced further to the take-up roller 212.

The operation of the punch 220, the movement of the film 201, the operation of the turret 230, any slider applicator, the spout-forming devices, the sealing bars 210, 272, the slider applicator and so forth are all controlled in a synchronised manner by control means (not shown).

It will be seen that, at the end of the operations described above, the length of zipper is secured in the opening 224 in the film in such a way as the inner flanges 50, 51 have been shaped and sealed together to form a spout, the lateral flanges 52, 53 are secured to the web to each side of the slot 224 and the outer flanges 48, 49 protrude from the slot so as to provide surfaces which may be conveniently gripped manually to pull the zipper profiles 40, 41 apart and thereby open the opening in the bag and allow the spout to be folded outwardly so as to provide a means of emptying product from the bag.

If the alternative zipper profile shown in FIG. 6 is used, the result is exactly analogous, with the outer flanges 148, 149 of the zipper protruding from the slot to facilitate opening of the engagement between the zipper profiles 140, 141.

If the zipper of FIG. 7 is used, there are no gripping flanges but the slider can instead be used for opening and closing the zipper profiles.

The process carried out on the apparatus shown in FIG. 8 is of the general kind known as a 'reel-to-reel' process, in which the film with the zippers attached is formed into a roll 212 which can be used in a subsequent process.

The subsequent process can be, for example, one in which the roll 212 is fed to a vertical or horizontal bag-making machine in which the film 201 is folded to form a bag such as that shown in FIGS. 1 to 3 which may be open along one edge for filling prior to sealing.

Alternatively, the film can be used in a form-fill-seal machine which again can be either vertical or horizontal and produces filled, sealed bags, for example similar to that of FIGS. 1 to 3 but filled with a product and sealed.

It is also possible to integrate the procedure of FIG. 8 with a bag-making procedure or a form-fill-seal procedure by replacing the roll 212 in FIG. 7 by appropriate equipment.

FIG. 15 of the drawings shows a vertically-operating form-fill-seal machine which can be integrated with the apparatus of FIG. 8 in the manner mentioned. The form-fill-seal machine shows, in conventional manner, a forming shoulder 400 which forms the web 201 into a tubular shape around a filling cylinder 402, into the hollow interior 404 of which product to be filled into the bags to be formed is fed. The longitudinal edges of the web 201 are overlapped and a back seal is formed by a vertical heated sealing bar 408. A traction belt 406 and another similar belt at the other side of the cylinder 402 draw the web 201 through the machine. Sealing and cutting bars 410, 412 operate in a known manner to sever the film into individual filled and sealed bags 414. The path of the web 201 through the machine is suitably relieved to allow passage of the zipper and the spout.

Similarly, FIG. 16 shows a horizontally-operating form-fill-seal machine which can likewise be integrated with the apparatus of FIG. 8. The FIG. 16 machine includes, in conventional manner, a folding box 420 which forms the web 201, into a tunnel shape around a belt (not shown) on which product to be filled into the bags to be formed is fplaced. The longitudinal edges of the web 201 are overlapped and a top seal is formed by a horizontal heated sealing bar (not shown). A traction device (also not shown) draws the web 201 through the machine. Rotary sealing and cutting bars 424, 422 operate in a known manner to sever the film into individual filled and sealed bags. The path of the web 201 through the machine is suitably relieved to allow passage of the zipper and the spout.

Either the machine of FIG. 15 or the machine of FIG. 16 can be replaced by a bag-making machine producing empty bags for subsequent use, either vertically or horizontally.

The invention claimed is:

1. A reclosable fastener comprising first and second strips of fastener material which are engageable with and disengageable from each other, each strip comprising an elongate body portion which is shaped for releasable engagement with the body portion of the other strip and first and second longitudinal flanges, wherein a plane of separation is located adjacent to the elongate body portions, the first flanges being configured for attachment to film of a bag, the first flanges aligned with the elongated body portions and extending substantially perpendicular from the plane of separation of the strips and the second flanges extending in the same direction substantially parallel to the plane of separation.

2. A reclosable fastener according to claim 1, in which the first flanges are narrower than the second flanges.

3. A reclosable fastener according to claim 2, in which the first flanges are at least one-half the width of the second flanges.

4. A reclosable fastener according to claim 1, in which each first flange is from 2 mm to 10 mm in width.

5. A reclosable fastener according to claim 1, in which each second flange is from 20 mm to 100 mm in width.

6. A reclosable fastener according to claim 5, in which each second flange is from 20 mm to 70 mm in width.

7. A reclosable fastener according to claim 1, fitted with at least one slider movable along the fastener to engage and disengage the fastener strips.

8. A reclosable fastener according to claim 1, in which each fastener strips has a third longitudinal flange which extends in a plane substantially parallel to the plane of separation in a direction opposite to that in which the respective second flange extends.

9. A reclosable fastener according to claim 8, in which each third flange is from 10 mm to 50 mm in width.

10. A reclosable fastener according to claim 9, in which each third flange is from 10 mm to 30 mm in width.

11. A reclosable fastener according to claim 8, in which the second and third flanges of each strip are substantially coplanar with each other.

12. A reclosable fastener according to claim 1, in which the first flanges extend in planes substantially perpendicular to the plane of separation.

13. A reclosable fastener comprising first and second strips of fastener material which are engageable with and disengageable from each other, each strip comprising an elongate body portion which is shaped for releasable engagement with the body portion of the other strip, each strip having at least first, second and third longitudinal flanges, wherein a plane of separation is located adjacent to the body portions, the first flanges being configured for attachment to film of a bag, the first flanges aligned with the elongated body portions extending away substantially perpendicular from the plane of separation of the strips.

14. A reclosable fastener according to claim 13, in which each first flange is from 2 mm to 10 mm in width.

15. A reclosable fastener according to claim 13, in which each second flange is from 20 mm to 100 mm in width.

16. A reclosable fastener according to claim 15, in which each second flange is from 20 mm to 70 mm in width.

17. A reclosable fastener according to claim 13, in which each third flange is from 10 mm to 50 mm in width.

18. A reclosable fastener according to claim 17, in which each third flange is from 10 mm to 30 mm in width.

19. A length of reclosable fastener according to claim 1, in which the second flanges of the strips are joined to each other and cut to form a spout portion.

20. A length of reclosable fastener according to claim 19, having a single spout portion.

21. A length of reclosable fastener according to claim 19, from which pre-determined lengths may be severed.

22. A length of reclosable fastener according to claim 19, in which the second flanges are joined along a line which extends from a first point adjacent one end of the body portions to a second point on the lateral edges of the second flanges lying closer to the opposite end of the body positions than the first end and are cut along respective lines extending from the second point back to the body portions.

23. A length of reclosable fastener according to claim 22, in which the lines along which the second flanges are cut extends substantially perpendicularly to the body portions.

24. A length of reclosable fastener according to claim 22, in which the line along which the second flanges are joined is curved in the direction away from the body portions.

25. A length of reclosable fastener according to claim 22, in which the portions of the second flanges lying to the side of the line along which they are joined distant from the body portions are removed.

26. A length of reclosable fastener according to claim 19, in which the portions of the second flanges lying to the side of the lines along which the flanges are cut opposite to the spout portion are removed.

27. A web of sheet material having a plurality of spaced openings therein, each opening having a length of fastener according to claim 1 located and secured to the sheet material by its first flanges to respective sides of the opening.

28. A web according to claim 27, in which the openings are spaced along and aligned with a line extending longitudinally of the web.

29. A web according to claim 28, which is in the form of a continuous rectangular strip and the line extends parallel to first and second opposite side edges of the strip.

30. A web according to claim 29, in which the line is substantially mid-way between the side edges.

31. A web according to claim 28, which is rolled longitudinally.

* * * * *